US005298953A

United States Patent [19]

Lindblad et al.

[11] Patent Number: 5,298,953

[45] Date of Patent: Mar. 29, 1994

[54] BIASED TRANSFER ROLL CLEANER

[75] Inventors: Nero R. Lindblad, Ontario; Bruce E. Thayer, Webster, both of N.Y.

[73] Assignee: Xerox Corporation, Stamford, Conn.

[21] Appl. No.: 52,979

[22] Filed: Apr. 27, 1993

[51] Int. Cl.[5] ..... G03G 21/00

[52] U.S. Cl. ..... 355/271; 355/299

[58] Field of Search ..... 355/271, 273, 277, 299, 355/274

[56] References Cited

U.S. PATENT DOCUMENTS

| | | | |
|---|---|---|---|
| 4,026,648 | 5/1977 | Takahashi . | |
| 4,382,673 | 5/1983 | Nakajima et al. . | |
| 4,970,560 | 11/1990 | Lindblad et al. | 355/299 |
| 5,168,313 | 12/1992 | Hosaka et al. | 355/274 |
| 5,233,394 | 8/1993 | Fujita et al. | 355/271 |

FOREIGN PATENT DOCUMENTS

| | | |
|---|---|---|
| 60-165683 | 8/1985 | Japan . |
| 60-166979 | 8/1985 | Japan . |
| 2-239271 | 9/1990 | Japan . |
| 4-37884 | 2/1992 | Japan . |

OTHER PUBLICATIONS

Xerox Disclosure Journal, Lubricantless Doctor Blade for Cleaning Electrostatographic Imaging Surfaces, by Stephen Strella, vol. 2, No. 5, Sep./Oct. 1977, p. 107.

Xerox Disclosure Journal, Impregnated Poromeric Material Cleaning Blade, by Paul R. Spencer and Donald J. Fisher, vol. 1, No. 4, Apr. 1976, p. 79.

*Primary Examiner*—R. L. Moses

*Attorney, Agent, or Firm*—Oliff & Berridge

[57] ABSTRACT

Apparatus for cleaning residual toner from a biased transfer roll (BTR) in an electrophotographic apparatus using a metal or polymeric blade. The cleaning apparatus includes, a cleaner housing mounted adjacent to the BTR, the housing comprising a cleaner sump to which the cleaning blade is rigidly mounted and positioned in interference with the BTR such that its beam deflection provides the force required to clean the surface of the BTR. The cleaning apparatus which is used for removal of residual toner particles from the hard, smooth surface of the BTR is low cost, efficient and significantly smaller than current BTR cleaning devices.

21 Claims, 3 Drawing Sheets

BIASED TRANSFER ROLL CLEANER

BACKGROUND OF THE INVENTION

1. Field of the Invention

This invention relates to an electrophotographic reproducing apparatus, and more particularly to a cleaning device for removing residual toner particles from the surface of a biased transfer roll (BTR).

2. Description of Related Art

Typical cleaning methods in electrophotographic applications such as xerography have included wiping with a fur brush or web and the like, a method using magnetism or a magnetic brush, a method using an air flow and/or combination of at least several of the above.

For example, a BTR cleaning apparatus 2 known in the art is depicted in FIG. 1 and includes a cleaner housing 43 with upstream and downstream air inlets 40. To be effective, such a brush cleaner must balance the air flows from the two sides of the housing 43. This is typically done by controlling the cleaner housing 43 spacing to the BTR 20, the spacing between the brush 3 and the cleaner housing inner wall 35 and/or by adding interferences 39 between the brush 3 and the cleaner housing inner wall 35 near an air inlet 40 to create a pressure situation which will effect the air flow (air flow direction indicated at arrow 11). A flicker bar 37 is provided to help knock the toner particles free of the brush 3 fibers. Thus, the brush 3 removes toner from the BTR 20 and the airflow detones the brush fibers.

The main disadvantages of the prior art device discussed above include large size, insufficient component life, BTR surface abrasion and high unit manufacturing costs.

Notably, cleaning devices employing a metal or polymeric blade to clean residual toner from the surface of a BTR have not been forthcoming in the art, due to concern that the metal blade in particular, might damage the BTR surface. Unfortunately, polymeric blade cleaning suffers from certain deficiencies as well, primarily resulting from the frictional sealing contact which must be maintained between the blade and the surface to be cleaned. Modern high volume BTR's, however, are made of hard and smooth materials, less susceptible to blade damage, as will be discussed below. Importantly, BTR's with hard and smooth surfaces are essential for use with the cleaning apparatus described herein.

Conversely, blades have been used to clean toner retentive imaging surfaces, such as photoreceptors in electrophotographic devices, for some time. For instance, the use of lubricated metal cleaning blades for cleaning a charge retentive or photoreceptor surface is described in U.S. Pat. No. 4,970,560, to Lindblad et al. Also, Xerox Disclosure Journal, Vol. 1, No. 4, April 1976, page 79, "Impregnated Poromeric Material Cleaning Blade", by P. Spencer and D. Fisher, suggests that a poromeric structure, such as a composite of polyester fibers bound together in polyurethane, may be impregnated with a lubricant, while Xerox Disclosure Journal, Vol. II, No. 5, September/October 1977, page 107, "Lubricantless Doctor Blade for Cleaning Electrostatographic Imaging Surfaces", by S. Strella, suggests to add a thin metal or plastic shim to the cleaning edge of an elastomeric blade to reduce blade wear and tuck unders, while enhancing blade cleaning performance.

Thus, it is important, for purposes of this invention, to clearly describe the general BTR function in the electrophotographic apparatus. Paper, to which the image is to be transferred, is fed into a nip formed by the BTR and the imaging surface, or photoreceptor. The BTR is rotated at the same speed and in the same direction as the photoreceptor so that no relative motion between the paper and the untransferred toner image occurs. A commonly used BTR consists of an aluminum core with a slightly conductive urethane rubber coating. A high bias is applied to the BTR core which creates an electric field at the paper thereby causing the charged toner particles to transfer from the photoreceptor surface to the paper. The advantage of using the BTR over corona transfer method is that the pressure created in the BTR nip flattens out any ripples or other perturbations in the paper which create gaps between the paper and the photoreceptor. Gaps increase the strength of the field needed to transfer toner to the paper and cause imperfections in the resulting copies. The same gaps can be caused by large particles, such as carrier beads or toner agglomerates from the developer housing. These create "tent" deletions which appear as white circles around the large particles. BTR's can improve the appearance of copies by greatly decreasing the diameter of the "tent" deletions.

Additionally, and perhaps most notably with respect to this invention, there is a need to clean the BTR surface because paper fibers from the backside of copy sheets can be attracted to the BTR and toner which occurs on the photoreceptor surface between the copy regions will also transfer to the BTR. This toner consists of low lever "background" toner, toner developed as a control patch used in maintaining the proper toner concentration and development field in the developer housing, and/or toner which accumulates on the lapped seam of the photoreceptor belt. If these materials are not cleaned from the BTR surface, they may retransfer to the back of copy sheets, appearing as spots and smudges, and if duplexed copies are being run, the spots and smudges will appear on both sides of the copies.

SUMMARY OF THE INVENTION

The improvement of this invention, therefore, is the use of a metal or polymeric blade to remove toner off the hard, smooth surface of a modern, high volume BTR. Such BTR's have wear properties that are approximately five times greater than the BTR discussed above and shown in FIG. 1. In addition, high volume BTR surfaces are hard and smooth.

Several important advantages arise when cleaning blades (metal or polymeric, as herein described) are used to clean BTRs. For instance, a metal blade (and an appropriately impregnated polymeric blade, for that matter) can be biased to a voltage, i.e., AC, DC or both, that will enhance cleaning. This allows the blade to operate at lower loads, thereby increasing both blade and BTR usable service life. Further, the harder blade materials allow cleaning without tucking. The wear mode of the untucked blade gives longer life because the cleaning edge is less stressed. Finally, cleaning blades can now be treated in a number of ways to increase hardness and reduce friction, thereby extending blade and BTR usable service life.

During development of the invention, the durability of the high volume BTR surface, when cleaned with a metal blade, was tested. The shiney, hard BTR surface showed no signs of scratches or abrasions after a representative time period of being cleaned by the metal blade. Additionally, the blade edge was examined using a microscope and it too showed no wear. Further, the blade load required to clean the BTR surface is low, i.e., in the range of about 10 gm/cm to about 30 gm/cm since the BTR surface is so smooth and the adhesion of toner to the surface is low. Additionally, a polymeric blade was similarly tested, also with excellent results.

It is thus an object of the invention to provide an improved apparatus for removing residual toner particles from the hard, smooth surface of a rotating BTR in an electrophotographic device.

It is another object of the invention to considerably reduce the manufacturing costs of the present systems for cleaning BTR surfaces.

It is still another object of the invention to provide a BTR cleaner that uses a metal or polymeric blade to remove residual toner therefrom, that is significantly smaller than the cleaner in FIG. 1, suffers much lower BTR and blade surface abrasion, and is cost effective to operate.

These and other objects and advantages are obtained by the inventive cleaning apparatus, for use in removal of residual toner particles from the hard, smooth surface of a rotating BTR in an electrophotographic device. The cleaning apparatus comprises a cleaner housing mounted adjacent to the BTR, the housing comprising a cleaner sump to which a cleaning blade is rigidly mounted and positioned in interference with the rotating BTR such that its beam deflection provides the force required to clean the surface of the BTR. The cleaning blade may either be a metal or polymeric structure of sufficient hardness (i.e., a Rockwell hardness for metal blades is in the range of about Rc 45 to about Rc 70; the hard polymeric blades should have a hardness of at least 85 Shore A, which corresponds to an initial modulus for the polymeric material in the range of about 1,000 psi to 1,000,000 psi) and mounted to interfere with the rotating BTR with a load in the range of about 10 gm/cm to about 30 gm/cm.

In accordance with another aspect of the invention, both the metal and polymeric blades are electrically conductive in order that, for a particular transfer current, a first DC current may be applied to the BTR and a second DC current may be applied to the cleaning blade, thereby creating an electric field between the BTR and the cleaning blade.

Additionally, the cleaning apparatus may further comprise, a means (as is well known in the art) for applying electrical bias voltage to and between the cleaning blade and the BTR and a means, such as a blower, for creating and controlling air flow into and through the cleaner sump. The air flow will facilitate removal of residual toner particles from the cleaner sump and prevent toner escape during the process.

Other objects, advantages and salient features of the invention will become apparent from the detailed description, which taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE PREFERRED EMBODIMENTS

As discussed above, there is a need to clean the BTR surface 21 because paper fibers from the backside of copy sheets can be attracted to the BTR surface 21 and toner which occurs on the photoreceptor surface 17 between the copy regions will also transfer to the BTR surface 21. This toner may consist of low level "background" toner, toner developed as a control patch used in maintaining the proper toner concentration and development field in the developer housing, and/or toner which accumulates on the lapped seam of the photoreceptor belt 17. If these materials are not cleaned on the BTR surface 21 they may retransfer to the back of copy sheets, appearing as spots and smudges, and if duplexed copies are being run, the spots and smudges will appear on both sides of the copies.

Figure 1:
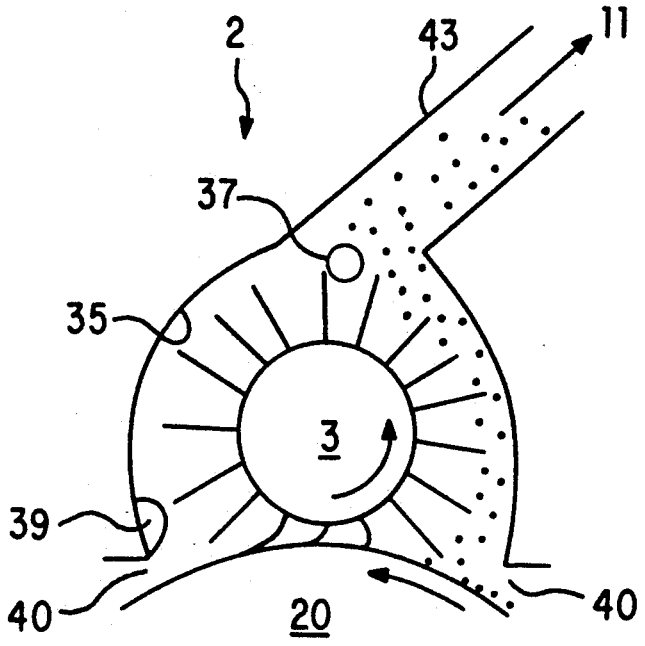
FIG. 1 PRIOR ART
FIG. 1 is a schematic side view of prior art cleaning apparatus.

Thus, this invention is for the use of a metal or polymeric blade 16 to remove toner from the hard, smooth surface 21 of a modern, high volume BTR 20. Such BTR's 20 have wear properties that are approximately five times greater than conventional BTR's, i.e., that shown in FIG. 1. In addition, high volume BTR surfaces 21 are hard and smooth.

Figure 2:
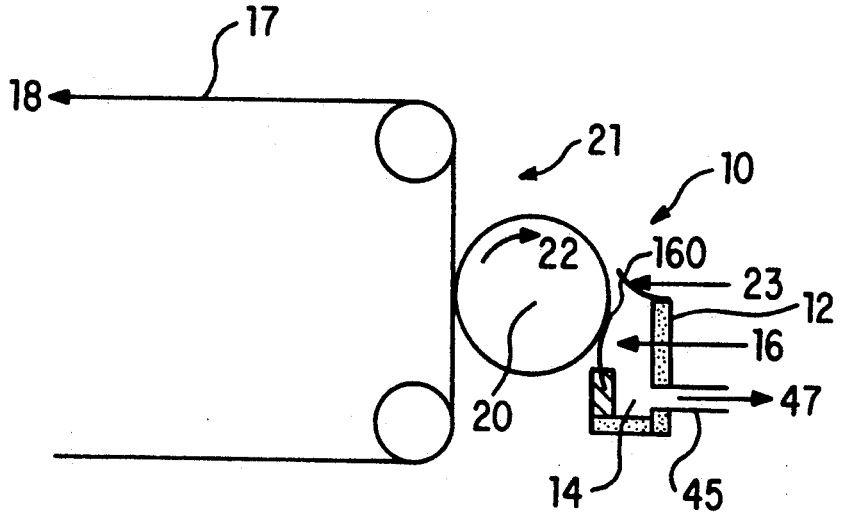
FIG. 2 is a schematic side view depicting the invention.

Referring first to FIG. 2, there is shown a first embodiment of the invention. Shown is an apparatus 10 for cleaning toner and paper fiber residue from the hard, smooth surface 21 of a rotating BTR 20 in an electrophotographic apparatus. A cleaner housing 12 is mounted adjacent to the BTR 20. The cleaner housing 12 comprises a cleaner sump 14, to which a cleaning blade 16 is rigidly mounted and fixedly positioned in interference with the rotating BTR 20 such that its beam deflection provides the force required to clean the BTR surface 21. A flexible flap seal 23 is also mounted to the cleaner housing 12 upstream of the cleaning blade 16 in the process direction. Additionally, the imaging surface of photoreceptor 17 is shown with a direction of movement indicated at arrow 18. The cleaner sump 14 may be connected by an air hose 45 to a blower 53 (see FIG. 3), with direction of residue and air movement indicated at arrow 47. The blower 53 is, however, not required for this embodiment, but may be provided as an alternative to the cleaning apparatus described above.

The cleaning blade 16 may either be a metal or polymeric structure of sufficient hardness (as discussed above) and mounted to interfere with the rotating BTR 20 with a load in the range of about 10 gm/cm to about 30 gm/cm. The cleaning edge 160 of the cleaning blade 16 will have a thickness in the range of about 0.001 inch to about 0,008 inch.

The cleaning blade 16 may, for example, comprise a metal blade or a metal blade substrate (e.g., carbon steel) with a hard metal coating (e.g., from the group comprising at least a phosphorous-nickel and a chrome-nickel alloy) deposited on the metal blade substrate and providing a plurality of pores. A lubricant layer (e.g., from the group comprising at least a fluorocarbon and a polytetrafluoroethylene) may then be infused into the pores of the hard metal coating to form a composite metal blade structure (e.g., as described in U.S. Pat. No. 4,970,560 to Lindblad et al. the disclosure of which is incorporated by reference) that is extremely hard and has a very low coefficient of friction.

Figure 6A:
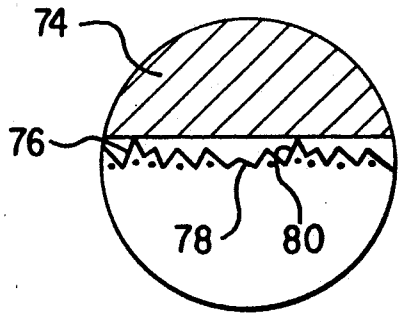
FIGS. 6A and 6B show a cross-section of the inventive hard metal lubricated cleaning blade before and after heating.
Figure 6B:
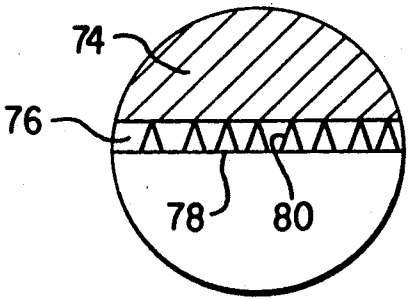

In FIG. 6A, a metal cleaning blade substrate 74 is shown, with a porous plating 76 and lubricant particles 78 in the pores 80 of the coating. After heating, as shown in FIG. 6B, the plating is hardened, producing a non-wearing surface that will prevent excessive wear of the blade due to friction. The pores in the plating are enlarged with heating, and the lubricant melts to fill the pores. The lubricant-filled pores at the blade surface produce a low friction exterior surface.

In accordance with another aspect of the invention (see FIG. 3), both the metal and polymeric blades may be electrically conductive in order that, for a particular transfer current, a first DC current may be applied to the BTR 20 and a second DC current may be applied to the cleaning blade 16 thereby creating an electric field between the BTR 20 and the cleaning blade 16.

Additionally, the cleaning apparatus may further comprise, a means (as is well known in the art) for applying electrical bias voltage to and between the cleaning blade 16 and the BTR 20 and a means, such as a blower 53, for creating and controlling air flow into and through the cleaner sump 14. The air flow will facilitate removal of residue from the cleaner sump 14 and prevent residue escape during the process.

Figure 3:
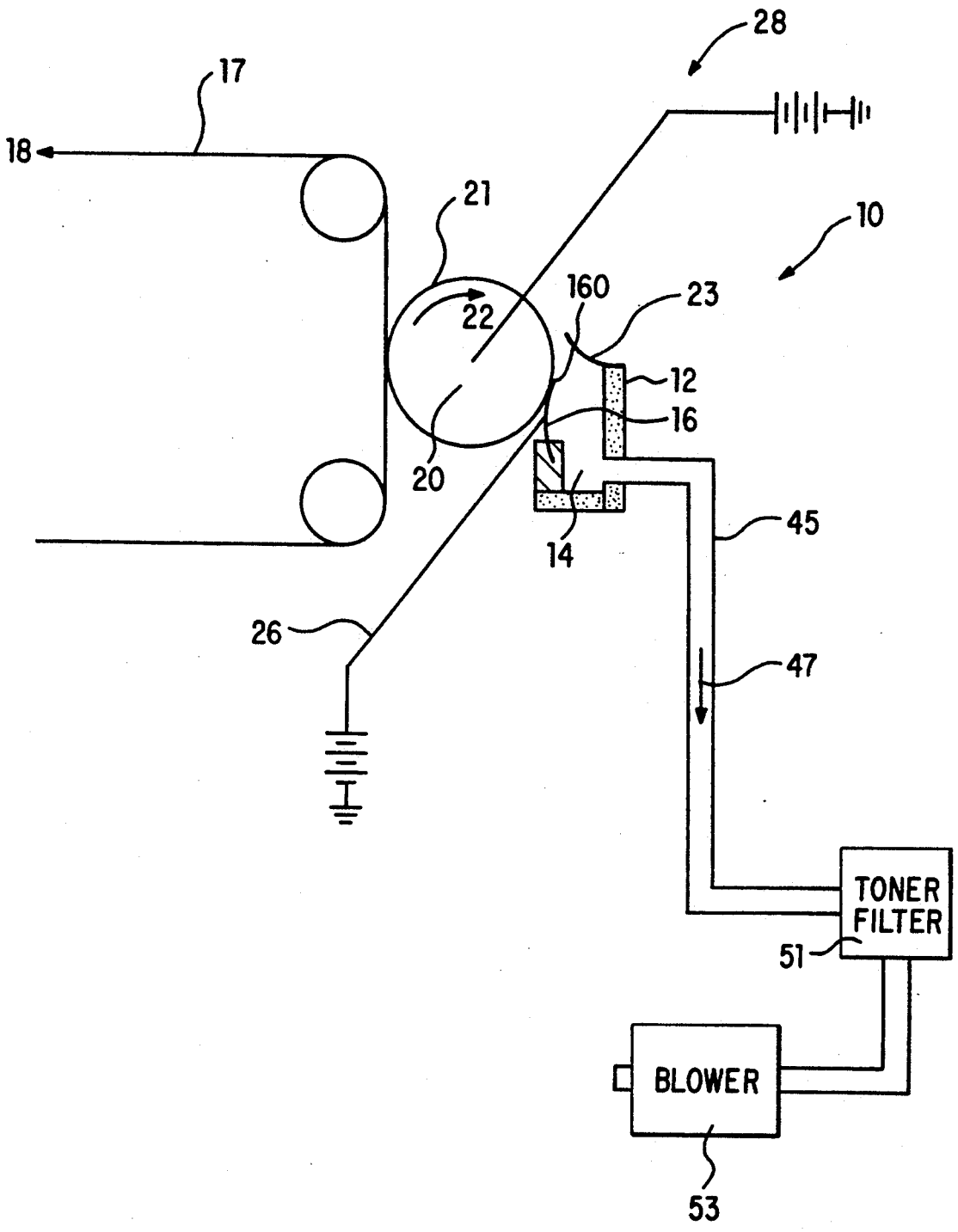
FIG. 3 is a schematic side view depicting an alternative embodiment of the invention.

Also in FIG. 3, portions of an electrophotographic apparatus are again shown, including an image forming surface of a moving photoreceptor 17 which is in contact with an electrically biased BTR 20. Also shown is the structural relationship between the BTR surface 21, the cleaning blade 16 and the cleaner sump 14. As toner and paper fiber residue are drawn into the cleaner sump 14 by action of the cleaning blade 16 and blower 53, the residue travels by means of an air hose 45 in the direction 47 and passes through a filter 51, where scavenged residue is collected. Power supplies for the cleaning blade 16 and BTR 20 are indicated at 26 and 28, respectively.

Figure 4:
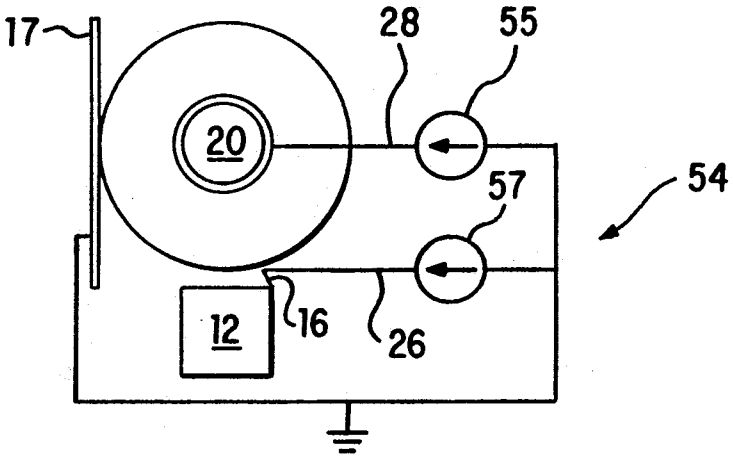
FIGS. 4 and 5 are schematic views depicting electrical relationships pertinent to the invention.
Figure 5:
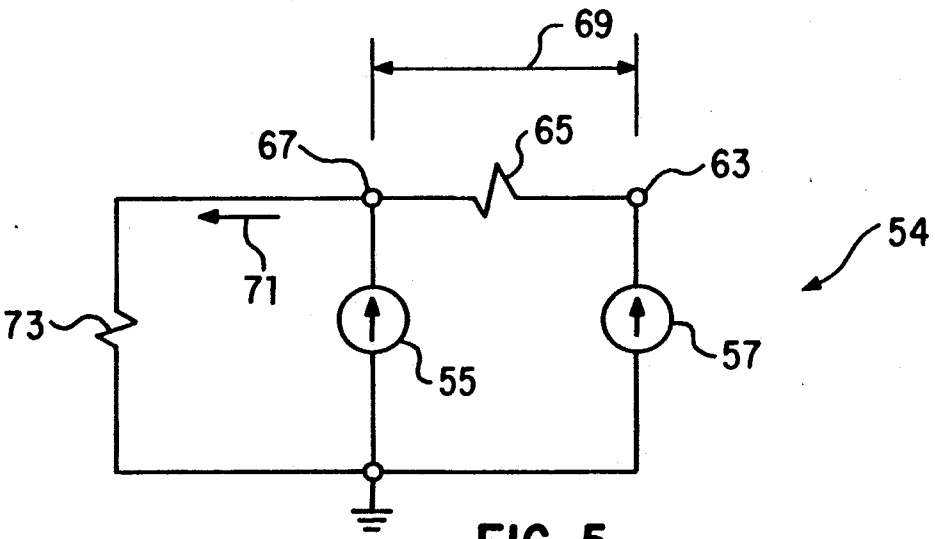

FIGS. 4 and 5 depict the BTR 20 and cleaning blade 16 constant current power supplies 26, 28 and bias relationships. In particular, FIG. 4 shows the BTR 20 and cleaning blade 16 biasing circuit 54, wherein BTR current 55 and cleaning blade current 57 are indicated. In FIG. 5, the relationship between BTR and cleaning blade current 55, 57 is shown, wherein transfer current 71 equals BTR current 55 plus cleaning blade current 57. In the circuit diagram 54, transfer current 71 is a function of BTR current 55 and cleaning blade current 57 which provides BTR voltage 67 and cleaning blade voltage 63 respectively. Further, the difference in voltage 69 (i.e., cleaning blade voltage) is a function of the resistance 65 (between cleaning blade 16 and BTR 20 core), while BTR resistance is indicated at 73.

While the invention has been described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. A cleaning apparatus, for use in removal of residual toner and paper particles from the hard, smooth surface of a rotating biased transfer roll in an electrophotographic device, the cleaning apparatus comprising:

a cleaner housing mounted adjacent to the biased transfer roll, the housing comprising a cleaner sump to which a cleaning blade is rigidly mounted and fixedly positioned in interference with the rotating biased transfer roll such that its beam deflection provides the force required to clean the surface of the biased transfer roll and a flexible flap seal, which is mounted to the cleaner housing upstream of the cleaning blade in the process direction.

2. The cleaning apparatus as described in claim 1, wherein the cleaning the cleaning apparatus further comprises:

means for creating and controlling air flow into and through the cleaner sump; and means for applying an electrical bias voltage between the cleaning blade and the biased transfer roll.

3. The cleaning apparatus as described in claim 1, wherein the cleaning blade comprises a metal blade and a thickness of a cleaning edge of the metal blade is in the range of about 0.001 inch to about 0.008 inch.

4. The cleaning apparatus as described in claim 3, wherein the metal blade is selected to provide a Rockwell hardness in the range of about Rc 45 to about Rc 70.

5. The cleaning apparatus as described in claim 3, wherein the metal blade is fixedly positioned against the rotating biased transfer roll with a load in the range of about 10 gm/cm to about 30 gm/cm.

6. The cleaning apparatus as described in claim 1, wherein the cleaning blade further comprises: of residual toner and paper particles from the hard, smooth a hard metal coating, deposited on the blade substrate and providing a plurality of pores; and a lubricant layer, infused into the pores of the hard metal coating to form a composite metal blade structure.

7. The cleaning apparatus as described in claim 6, wherein the metal blade substrate is a carbon steel.

8. The cleaning apparatus as described in claim 7, wherein the metal blade substrate is carbon steel cut to desired shape and size.

9. The cleaning apparatus as described in claim 8, wherein a cleaning edge of the composite metal blade structure is in the range of about 0.001 inch to about 0.008 inch.

10. The cleaning apparatus as described in claim 9, wherein the hard metal coating is selected to provide a Rockwell hardness in the range of about Rc 45 to about Rc 70.

11. The cleaning apparatus as described in claim 6, wherein the hard metal coating is from a group comprising at least a phosphorous-nickel and a chrome-nickel alloy.

12. The cleaning apparatus as described in claim 6, wherein the lubricant layer is from a group comprising at least a fluorocarbon and a polytetrafluoroethylene.

13. The cleaning apparatus as described in claim 6, wherein the composite metal blade structure is fixedly positioned against the rotating biased transfer roll with a load in the range of about 10 gm/cm to about 30 gm/cm.

14. The cleaning apparatus as described in claim 1, wherein the cleaning blade comprises a polymeric blade.

15. The cleaning apparatus as described in claim 14, wherein the polymeric blade is selected to provide a hardness in the range of at least 85 Shore A.

16. The cleaning apparatus as described in claim 14, wherein the polymeric blade further comprises a suitable electrically conductive material impregnated into the polymeric blade structure.

17. The cleaning apparatus as described in claim 14, wherein the polymeric blade is fixedly positioned against the rotating biased transfer roll with a load in the range of about 10 gm/cm to about 30 gm/cm.

18. The cleaning apparatus as described in claim 2, wherein the air flow creating and controlling means comprises a blower connected to the cleaner sump by means of an air hose.

19. The cleaning apparatus as described in claim 18, further comprising a toner filter disposed in communication with the cleaner sump via the air hose, such that removed toner particles are deposited in the toner filter.

20. The cleaning apparatus as described in claim 2, wherein, for a particular transfer current, a first DC current is applied to the biased transfer roll and a second DC current is applied to the cleaning blade creating an electric field between the biased transfer roll and the cleaning blade.

21. The cleaning apparatus as described in claim 2, wherein the residual toner particles are removed from the biased transfer roll surface by combined action of the electrical bias between the cleaning blade and the biased transfer roll, and interfering contact of the cleaning blade against the rotating biased transfer roll.

* * * * *